United States Patent [19]

van Moppes

[11] 3,971,167

[45] July 27, 1976

[54] TUMBLING APPARATUS

[76] Inventor: Michael van Moppes, Lilac Cottage, Alresford, Hampshire, England

[22] Filed: June 11, 1975

[21] Appl. No.: 586,012

Related U.S. Application Data

[63] Continuation of Ser. No. 429,845, Jan. 2, 1974, abandoned.

[30] Foreign Application Priority Data

Feb. 28, 1973 United Kingdom ..... 9852/73

[52] U.S. Cl. ..... 51/164; 241/176; 259/57

[51] Int. Cl.[2] ..... B24B 31/02

[58] Field of Search ..... 241/176, DIG. 2; 259/57; 51/164

[56] References Cited

UNITED STATES PATENTS

| | | | |
|---|---|---|---|
| 1,144,272 | 6/1915 | West | 51/164 UX |
| 1,984,237 | 12/1934 | Southan | 51/164 UX |
| 3,579,921 | 5/1971 | Bobo | 51/164 |
| 3,726,046 | 4/1973 | Dreher | 51/164 |

*Primary Examiner*—Harold D. Whitehead
*Attorney, Agent, or Firm*—Robert Andrew Brown

[57] ABSTRACT

A tumbling apparatus having a plurality of tumbling barrels for use primarily for grinding or polishing semi-precious stones or the like. The apparatus having a single motor for directly and indirectly rotating the barrels, the barrels having peripheral drive portions in the form of gear teeth which are of different diameter so that different rotation speeds for the barrels may be made.

8 Claims, 3 Drawing Figures

Figure 1:
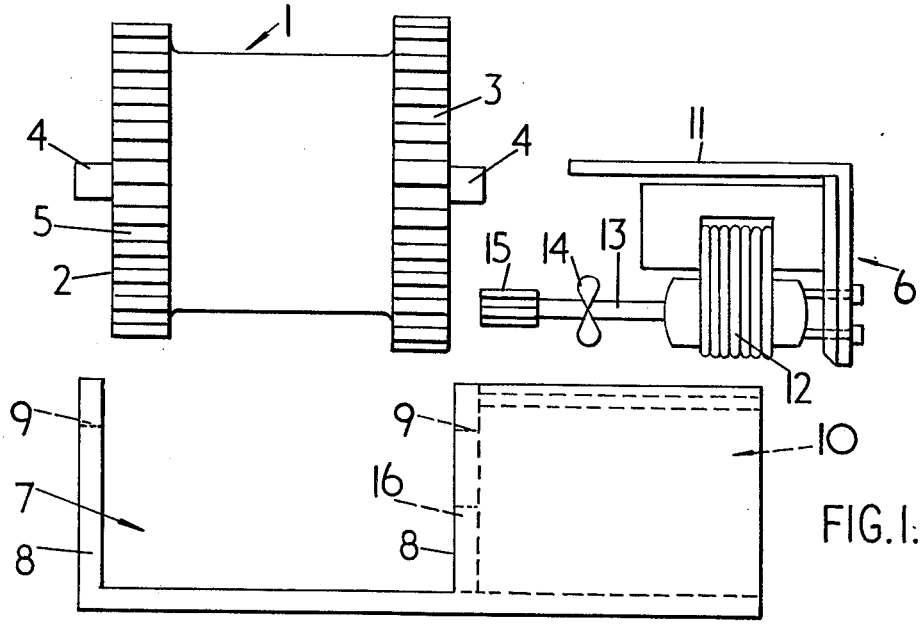

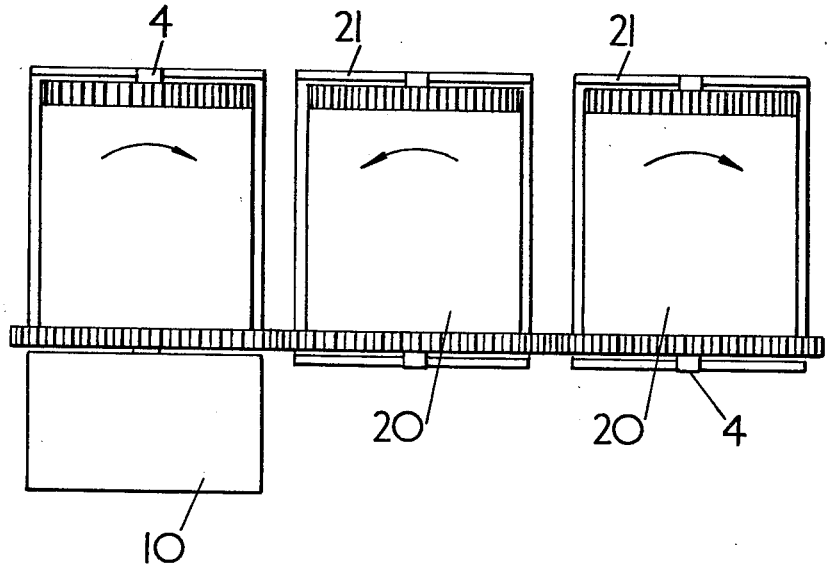
FIG. 2.
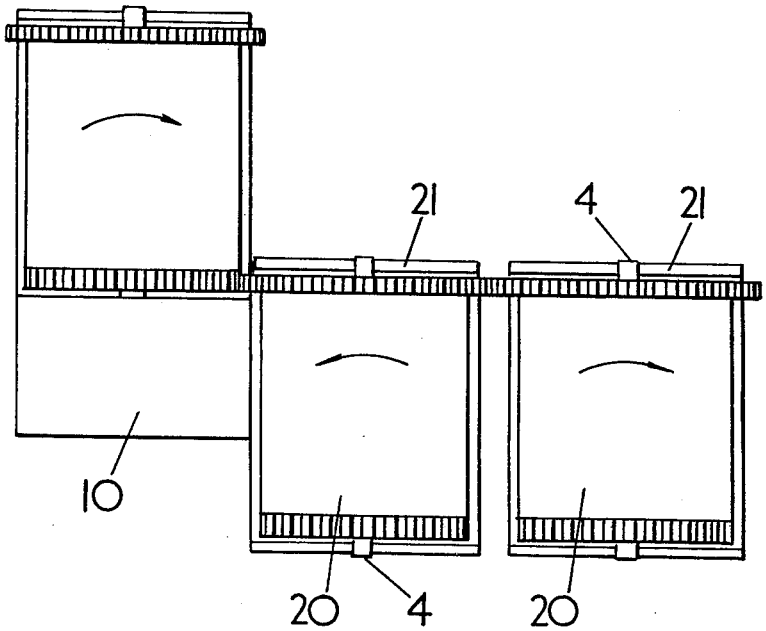

TUMBLING APPARATUS

This is a continuation, of application Ser. No. 429,845, filed Jan. 2, 1974, now abandoned.

The present invention relates to tumbling machine arrangements useful, for example, for the barrel grinding or polishing of semi-precious stones and the like.

A conventional type of tumbling machine for the above purposes consists of a frame into which is incorporated a small electric motor. The motor drives one or two drive shafts via gear wheels or via a pulley and belt and these shafts in turn rotate a small tumbler barrel. Stones together with an abrasive powder and water are located in the barrel, and the tumbling action caused by rotation effects grinding and polishing of the stones.

Other conventional tumblers utilize vibration as a means of causing the stones and abrasives to be turned inside the barrel.

The present invention provides a tumbling machine arrangement comprising a tumbler barrel supported for rotation about its longitudinal axis and having two circular external peripheral drive surfaces of different diameter from each other arranged co-axially with the barrel, and drive means engageable with either one of said drive surfaces to impart rotation to the barrel.

Preferably, the axial orientation of the barrel is reversible to provide for alternative engagement of the drive means with either one of said drive surfaces.

The barrel has two mounting shafts protruding axially from the centre of the ends, thus enabling the barrel to be rotated about its longitudinal axis. The barrel is manufactured with two gear rings or other means of drive, such as friction rollers, moulded or attached to its periphery, either of which, when engaged with a drive, provides rotation of the barrel.

The axially projecting spigots, mentioned above are adapted to fit into slots in a pair of spaced uprights on the tumbler frame, these forming bearings for rotatably suspending each barrel. The frame of the driven barrel further has means for releasably locating a motor unit to drive the suspended barrel.

Ideally Lapidary tumbling machines should have more than one speed. This is necessary so that the grinding of the semi-precious stones can be done at a high speed and the polishing at a low speed. The most conventional tumblers have only one speed, this means that one of these operations is done incorrectly (either the stone is ground too slowly or a poor polish is obtained).

The drive mechanism of the present invention enables a multi-speed tumbler to be constructed at a very low manufacturing cost. The barrel is manufactured with two different diameters of which one could be a main tumbler barrel and the other the lid. A gear ring or other means of drive is integrally manufactured or attached to each different diameter. Thus, to change speed it is only necessary to remove the tumbler barrel from the frame, raise or lower the bearing slots situated in the spaced uprights of the frame, turn the barrel through 180°, and replace it in the frame so that the axially projecting shafts drop into the bearing surfaces. If the circumference of the lid is 1/6th larger than the circumference of the body, a change of speed of 1/6th is obtained. By altering the design of the tumbler barrel, many speed variations are possible.

In Lapidary polishing it is desirable to have spare barrels for additional grinding operations and for polishing. The invention removes the need for additional tumbler barrels with motors by providing further barrels linked to and driven by a main driven barrel unit.

It is now possible to utilize a main driven barrel unit as the basic tumbler and to place beside it further barrel units in such a way that the transmission surfaces, such as gear teeth, are integrally engaged or meshed and thus the motor power of the main driven barrel unit is transmitted through to the further barrel units thus causing them to turn. In this way it is possible to run several further barrel units; hereafter referred to as idler barrel units, from one main driven barrel unit. The exact positioning of the idler barrel units can be made by moulding screw holes into the base of each unit so that they may be fixed to a base board.

Furthermore, by arranging the idler barrel units in such a way that the large gear teeth on the main driven barrel unit engages the small gear on the idler barrel unit, or vice versa, it is possible to obtain a multi-speed as well as a multi-barrelled set-up.

Accordingly, the present invention provides a tumbling machine arrangement comprising at least one tumbler barrel, means mounting each barrel for rotation about its longitudinal axis, and drive means for rotating one of the barrels, an external peripheral portion around said one of the barrels being adapted to cooperate with the drive means for rotation of said one of the barrels, external peripheral portions of any remaining barrels for contacting at least indirectly, with the driven barrel for rotation thereof.

Preferably, there are a plurality of idler barrels which may be rotated by the driven barrel.

Furthermore, the external peripheral portion of the driven barrel preferably comprises gear teeth adapted to mesh with a driving gear of the drive means, the external peripheral portions of the idler barrels comprising gear teeth for mesh at least indirectly, with the gear teeth of the driven barrel for rotation thereof.

The gear teeth may be formed integrally with each barrel or attached thereto.

Preferably, each barrel is provided with axially projecting shafts, adapted to fit into slots in a pair of spaced uprights of the frame, to form bearings for rotatably suspending each barrel, the frame of said driven barrel further having means for releasably locating a motor unit to drive the suspended barrel.

Conveniently, each barrel, with integrally formed gear teeth, and its respective frame, are moulded from synthetic plastics material.

Furthermore the said driven barrel may have a lid provided with gear teeth of a different external diameter to the barrel gear teeth whereby, when the driven barrel and lid is removed from the mounting means and turned about a vertical axis before replacement on the mounting means, the lid gear teeth may be meshed with the driving gear for rotation of the barrel, thus providing two possible barrel rotation speeds.

The present invention will now be described, by way of example, with reference to the accompanying drawings in which FIG. 1 is an exploded view of a tumbling machine arrangement for grinding or polishing semi-precious stones or the like.

Figure 3:
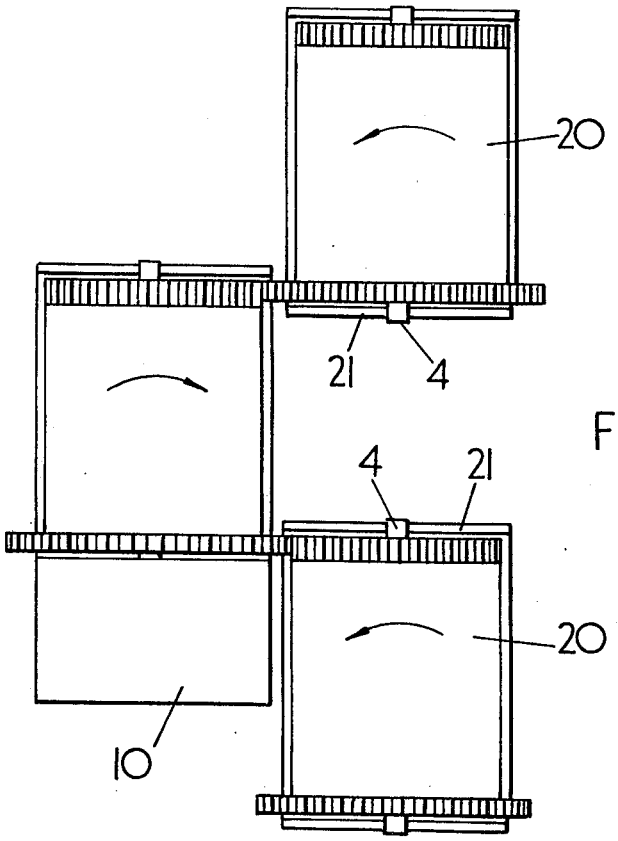

FIGS. 2 and 3 illustrate multi-barrel layouts, each of which may provide barrels with different rotation speeds.

The tumbler barrel 1, in FIG. 1, having a lid 2 for the charging and discharging of stones and abrasive medium, is of size comparable to known machines of this type and is made of injection moulded synthetic plastics material, nylon or like material. Gear ring 3 is integrally moulded around the outside of the barrel at one end, and the barrel has axially projecting shafts 4. However, more than one gear ring 3 may be formed around the barrel to provide additional facility for speed variation of the driven barrel.

The lid 2 also has a gear ring 5 integrally moulded around the outside rim of the lid 2. The lid gearing 5 is of greater or lesser diameter than the barrel gear ring. Thus by turning the barrel about a vertical axis, barrel gear ring 3 or lid gear ring 5 may be meshed with and driven by a motor assembly 6, thus giving two different possible speeds.

A frame 7 also of injection moulded material, comprises a pair of uprights 8 with slots 9 to form bearings for the shafts 4 so as to rotatably suspend the barrel and a motor compartment 10. The motor assembly 6 comprises a perforated L-shaped metal frame 11 carrying a motor 12 having a drive shaft 13 with attached fan 14 and spur gear 15. The motor may, however, be fitted elsewhere in the frame. On assembly, the metal frame 11 slots into side members of the motor compartment 10, and the spur gear 15 protrudes through an opening 16 in one of the uprights 8 to mesh with the gear teeth of the barrel gear ring 3 or lid gear ring 5 for driving the barrel.

A speed-reducing idler gear could be interposed between the spur gear 15 and the barrel teeth if required.

In the tumbler machine arrangement according to the present invention, there may be one or more idler barrels 20 (FIG. 2) having integral barrel gear teeth and also integral gear teeth on a respective barrel lid. The idler barrels may be arranged for rotation on axis parallel with the axis of the motor driven barrel, their gear teeth meshed with the driven barrel or lid gear teeth. Thus the arrangement provides extra barrels which may be driven at the same or different speeds from the motor driven barrel. A frame 21 for each idler barrel does not comprise a motor compartment 10, as with the motor driven barrel frame, but only the uprights 8 with slots 9 which form bearings for the barrel shafts 4.

The idler barrel frames may be simply produced by injecting synthetic plastics material into only a relevant part of the metal frame mould. For this purpose the metal mould is made in two parts, the plastic being injected only into the relevant part of the mould.

Conveniently, each idler barrel frame may also have screw apertures or like attachment means with which they can be fixed to a base board.

The "add an idler barrel frame" feature is illustrated in FIGS. 2 and 3, these drawings illustrating only three of many possible layouts and also illustrates how the same or multiple barrel speeds can be obtained.

Although but one embodiment of the invention is disclosed and described herein, it is apparent that other embodiments and modifications are possible within the scope of the appended claims.

I claim:

1. Tumbling apparatus comprising a circular sectioned tumble-barrel, two mutually exclusive external peripheral drive surfaces of different diameters formed about said barrel and spaced equally from the longitudinal center of said barrel, a base member for said barrel, drive means supported on said base member for engaging one of said mutually exclusive drive surfaces to directly rotate said barrel, and mounting means secured to said base member for supporting said barrel for rotation about its longitudinal axis so that the axial orientation of the barrel may be reversed to provide for alternative engagement of a selected one of said drive surfaces with said drive means to rotate said barrel at two alternative speeds of rotation of said barrel for a given speed of rotation of the drive means.

2. The tumbling apparatus of claim 1 comprising a plurality of idler barrels for rotation, at least indirectly, by said tumbler barrel.

3. A tumbling apparatus as claimed in claim 1, wherein one of said drive surfaces is provided in a lid portion constituting one end of the barrel.

4. A tumbling apparatus as claimed in claim 1, and further comprising one or more additional barrels supported for rotation on axes parallel to the axis of said tumbler barrel, each said additional barrel having at least one circular external peripheral drive surface for engagement with a drive surface of an adjacent barrel, whereby each said additional barrel is driveable from said tumbler barrel either directly or by at least one of the additional barrels.

5. A tumbling apparatus as claimed in claim 4 wherein the drive means includes a toothed driving wheel and the driving surfaces of each barrel are provided with teeth for meshing engagement at times with said driving wheel and at times with the driving surface of an adjacent barrel.

6. A tumbling apparatus as claimed in claim 4 wherein each said barrel is provided with axially projecting shafts, adapted to fit into slots in a pair of spaced uprights of a frame to form bearings for rotatably supporting each said barrel, the frame of said tumbler barrel further having means for releasably locating a motor unit to drive said tumbler barrel.

7. A tumbling apparatus as claimed in claim 6, wherein each said barrel, including said teeth, and each respective frame are molded from synthetic plastics material.

8. A tumbling apparatus as claimed in claim 6, further comprising a base board to which each said frame is attachable.

* * * * *